US007758823B2

(12) United States Patent
Spicer et al.

(10) Patent No.: US 7,758,823 B2
(45) Date of Patent: Jul. 20, 2010

(54) QUENCH EXCHANGE WITH EXTENDED SURFACE ON PROCESS SIDE

(75) Inventors: David B. Spicer, Houston, TX (US); Wallace L. Ottersbach, Kingwood, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 418 days.

(21) Appl. No.: 11/891,515

(22) Filed: Aug. 10, 2007

(65) Prior Publication Data

US 2008/0083656 A1 Apr. 10, 2008

Related U.S. Application Data

(60) Provisional application No. 60/844,186, filed on Sep. 13, 2006.

(51) Int. Cl.
*F28D 7/00* (2006.01)
*F28D 7/10* (2006.01)

(52) U.S. Cl. ..... 422/200; 422/198; 422/201; 165/183; 165/177; 165/154; 208/48 Q; 585/950

(58) Field of Classification Search ..... 422/198, 422/200, 201; 165/183, 177, 154; 208/48 Q; 585/950

See application file for complete search history.

(56) References Cited

U.S. PATENT DOCUMENTS

| | | | | |
|---|---|---|---|---|
| 4,457,364 | A | 7/1984 | DiNicolantonio et al. | |
| 4,703,793 | A | 11/1987 | Townsend | |
| 5,186,815 | A * | 2/1993 | Lenglet | 208/48 R |
| 5,409,675 | A | 4/1995 | Narayanan | |
| 6,419,885 | B1 * | 7/2002 | Di Nicolantonio et al. | 422/198 |
| 2008/0014342 | A1 | 1/2008 | Jakobi et al. | |

FOREIGN PATENT DOCUMENTS

| | | |
|---|---|---|
| DE | 10 2004 039356 | 2/2006 |
| EP | 0 974 803 | 1/2000 |
| EP | 0 980 729 | 2/2000 |
| GB | 969 796 | 9/1964 |
| JP | 62 011797 | 1/1987 |
| WO | WO 98/56872 | 12/1998 |

OTHER PUBLICATIONS

H. Herrmann et al., Latest Developments in Transfer Line Exchanger Design for Ethylene Plants, Apr. 1994, pp. 193-220, A1ChE Spring National Meeting, Atlanta, Paper No. 23c.

* cited by examiner

*Primary Examiner*—Walter D Griffin
*Assistant Examiner*—Lessanework Seifu

(57) ABSTRACT

A quench exchanger and quench exchanger tube with increased heat transfer area on the process side of the tube are provided. The exchanger provides increased heat transfer efficiency relative to a fixed tube length and at the same time eliminates stagnant and low velocity areas as well as recirculation eddies. The tubes incorporate a fin profile on the process side of the tube with alternating concave and convex surfaces. Additionally, the fins are preferably aligned with the tube center line as opposed to being twisted or spiraled.

21 Claims, 3 Drawing Sheets

QUENCH EXCHANGE WITH EXTENDED SURFACE ON PROCESS SIDE

CROSS REFERENCE TO RELATED APPLICATIONS

This application claims priority to and benefit of Provisional application filed on Sep. 13, 2006, U.S. Ser. No. 60/844,186.

FIELD OF THE INVENTION

The present invention relates generally to heat exchangers and more particularly to a quench exchanger with improved heat transfer characteristics.

BACKGROUND OF THE INVENTION

The production of ethylene requires a number of process steps through which any of a variety of hydrocarbon feeds can be refined to generate various products including ethylene. The predominate process for producing ethylene is steam cracking. According to this process, hydrocarbon feed is heated in cracking furnaces and in the presence of steam to high temperatures. It is well known in the industry that shorter residence times within the furnaces results in a desirable selectivity to ethylene.

As such, once the desired conversion of feed has been achieved, the process gas must be rapidly cooled, or quenched, to minimize undesirable continuing reactions that are known to reduce selectivity to ethylene. The vast majority of ethylene furnaces currently in use employ so-called "transfer-line-exchangers" (TLEs), also referred to as "quench exchangers", for this purpose. These devices are heat exchangers that rapidly cool the process gas by generating steam. The resulting steam is typically generated at high pressures (e.g. 600 to 2000 psig; 4150 to 13800 kpag).

Many of the TLEs in service employ a double pipe or double tube construction with the high temperature cracking furnace effluent introduced into the interior pipe, with a cooling medium such as water being introduced into the annular space between the two tubes. Double pipe exchangers may be configured as bundles or as so-called "linear" units. The advantage of the linear type units is that the adiabatic time between the furnace outlet and the cooling tube inlet can be minimized to allow an enhanced ethylene selectivity. Linear units also benefit from the lack of a tubesheet area which would otherwise be exposed to the hot process gas and are thus subject to various mechanical and erosion concerns. Further, in linear units, the process flow is more evenly distributed among the cooling tubes.

In order to achieve best selectivity to ethylene, it is necessary to minimize both the residence time ("fired time") and the adiabatic time ("unfired residence time") within an ethylene furnace. The unfired residence time refers to the amount of time required for the process effluent to pass from the fired zone of the furnace to the entrance of the TLE. One set of existing solutions which have been developed to minimize adiabatic time are typically called "close-coupled" type quench exchangers. According to this design, the quench exchanger tubes are connected directly to the furnace effluent tubes without intermediate manifolding.

Examples of this type of exchanger can be found in FIGS. 15, 16 and 17 of Herrmann and Burghardt, "Latest Developments in Transfer Line Exchanger Design for Ethylene Plants", prepared for the presentation at AIChE Spring National Meeting, Atlanta, Ga., April 1994. Another close-coupled design is presented in U.S. Pat. No. 4,457,364, which discloses a "Close-Coupled Transfer Line Heat Exchanger Unit." According to this design, "close-coupling" of the quench exchanger is achieved by using a dividing fitting which connects a radiant outlet tube to two or more quench exchanger tubes using a streamlined fitting. Using this arrangement, the quench exchanger tubes have a smaller inside diameter than the radiant tubes which feed them. Although this arrangement does achieve a low adiabatic residence time and thus has high selectivity to ethylene, it has presented problems in practical operation.

In particular, coke segments that have formed on the inner surface of the radiant tubes, when spalled off the tubes, have proven to not always be able to pass through the smaller diameter quench exchanger tubes. As such, furnaces so equipped must periodically be shut down to remove coke blockages from the quench exchanger inlet upstream of the heat exchanger tubes. As a result, current "close-coupled" quench exchanger designs require the quench exchanger tubes to be larger in diameter than the radiant coil outlet tube. Further, it is preferred to have no dividing fittings between the radiant outlet tube and the quench exchanger tube as in the design of U.S. Pat. No. 4,457,364 because these fittings can also create similar blockage problems.

In single pass radiant coil implementations, such as that shown in FIG. 15 of Herrmann, et al., it is possible to complete all the quench exchanger steam generation in a single pass. However, if two radiant tubes are combined into a single, larger diameter quench exchanger tube (as is geometrically advantageous and which eliminates the blockage problems of the U.S. Pat. No. 4,457,364 design), the quench exchanger length may approach or exceed the limits of commercial fabrication and shipping capabilities which are currently at approximately 60 linear feet (18.3 linear meters).

If a U-tube radiant coil is used, the flow rate per tube and the tube diameter increases and it is therefore not always possible to complete the desired steam generation in a single pass. The Herrmann reference presents two solutions in FIGS. 16 and 17, respectively. In the FIG. 16 embodiment, a two pass quench exchanger is used. In FIG. 17, a single pass quench exchanger is close coupled to the furnace coil and the effluent tubes of the single pass exchanger are manifolded together. Steam generation is completed in a circular TLE. Since the manifolding is performed after the effluent is quenched, there is no loss of selectivity to ethylene.

A similar approach to that shown in FIG. 17 may be undertaken using serpentine coils with 4 to 6 radiant tubes per pass. Such tubes generally have inside diameters in the range of 3 to 4 inches (76 to 100 mm). One drawback of this approach is that the close coupled exchanger must be able to cool the furnace effluent to approximately 1100° F. (590° C.) after the first pass to ensure that no reaction occurs in the higher residence time manifolding required upstream of the circular quench exchanger. As a result, this has effectively prevented the use of single pass, close coupled quench exchangers which include ethylene furnace coils having inside diameters of greater than about five inches (125 mm).

Ethylene furnaces are typically used for the production of a wide variety of products. This includes hydrogen at the light end to steam-cracked tar at the heavy end. As a general matter, the heavier the feedstock, the greater the yield of steam-cracked tar. In naphtha crackers, the effluent composition contains a tar content that is high enough that the heaviest components will commence condensing if cooled to approximately 600° F. (315° C.). As feed stocks get heavier, the tar yield rises and the temperature at which condensation commences also rises. Should condensation of the effluent occur in the quench exchanger, heat transfer is substantially impeded and a sharp increase in effluent outlet temperature results.

Since quench exchangers cool the effluent by generating steam at approximately 2000 psig (13,800 kpag) or less, the quench exchanger wall is generally at approximately 635° F. (335° C.) or less. It is therefore very important to prevent areas of low velocity or recirculation eddies in the quench exchanger tubes. If such areas exist, the effluent can be cooled to at or below its dew point and quench exchanger fouling can result.

SUMMARY OF THE INVENTION

In one aspect of the invention, a heat exchanger tube is provided. In this embodiment, the heat exchanger tube has a longitudinal axis, an interior surface defining the flow area of the tube, and an interior circumference in a plane perpendicular to the longitudinal axis; wherein the interior surface comprises a plurality of axially extending grooves aligned with the longitudinal axis; the grooves formed along the length of the tube and formed as a series of alternating concave and convex surfaces along at least a portion of the interior circumference; and wherein the length of the perimeter of the interior surface in the plane is at least about twenty percent longer than the interior perimeter of a circular tube having substantially the same flow area as the heat exchanger tube.

In another aspect of the invention, a transfer line heat exchanger unit connected to a steam cracking furnace is provided. In this embodiment, furnace effluent flows from a furnace outlet into at least one heat exchanger tube for cooling the furnace effluent; wherein the at least one heat exchanger tube has a longitudinal axis, an interior surface defining the furnace effluent flow area of said tube, and an interior circumference in a plane perpendicular to the longitudinal axis; and wherein the interior surface comprises a plurality of axially extending grooves aligned with the longitudinal axis; the grooves formed along the length of said tube and formed as a series of alternating concave and convex surfaces along at least a portion of the interior circumference; and wherein the length of the perimeter of the interior surface in the plane is at least about twenty percent longer than the interior perimeter of a circular tube having substantially the same flow area as the heat exchanger tube.

In another aspect of the invention, the heat exchanger tube is used to cool effluent from a hydrocarbon cracking furnace and is fed by at least one radiant tube associated with the furnace.

In another aspect of the invention, the concave and convex surfaces of the heat exchanger tube form a plurality of convex fins, and wherein the number of convex fins is equal to about 5 to about 7 times the inside diameter of the heat exchanger tube when measured in inches.

In another aspect of the invention, each of the concave surfaces of the heat exchanger tube has a concave nadir and each of said convex surfaces of the heat exchanger tube has a convex pinnacle; and wherein each of the convex pinnacles is located at substantially the same distance from the longitudinal axis and each of the convex nadirs are located at the same distance from the longitudinal axis. And in one embodiment, the convex pinnacles are located from about 0.75 inches (19.0 mm) to about 2.75 inches (69.8 mm) from the longitudinal axis; and each of the concave nadirs are located from about 1.0 inches (25.4 mm) to about 3.0 inches (76.2 mm) from the longitudinal axis.

In another aspect of the invention, the inside diameter of the heat exchanger tube is about 2 to about 3 inches (about 50 to about 76 mm) and the wall thickness of said heat exchanger tube is about 0.3 to about 0.5 inches (about 7.6 to 12.7 mm). And in one embodiment, each of the convex pinnacles are located from about 0.75 inches (19.0 mm) to about 1.4 inches (35.6 mm) from the longitudinal axis; and each of the concave nadirs are located from about 1.0 inches (25.4 mm) to about 1.5 inches (38.1 mm) from the longitudinal axis.

In another aspect of the invention, the length of the heat exchanger tube is from about 15 feet to about 60 feet (about 4.5 meters to about 18 meters).

In another aspect of the invention, the height of each groove is from about 0.1 inches (2.54 mm) to about 0.3 inches (7.62 mm).

In another aspect of the invention, the heat exchanger tube has an inside diameter of about 2 to about 6 inches (about 50 to about 152 mm); a wall thickness of about 0.2 to about 0.6 inches (about 5.1 to 15.2 mm); a groove height from about 0.1 inches (2.54 mm) to about 0.3 inches (7.62 mm); and a length of about 15 feet to about 60 feet (about 4.5 meters to about 18 meters).

The heat exchanger tube disclosed herein provides increased heat transfer efficiency relative to a fixed tube length and at the same time eliminates stagnant and low velocity areas as well as recirculation eddies. These benefits are obtained through the use of a fin profile fabricated with alternating concave and convex surfaces. Additionally, the fins are preferably aligned with the tube center line, or longitudinal axis, as opposed to being twisted or spiraled.

These and other advantages and features are described herein with specificity so as to make the present invention understandable to one of ordinary skill in the art.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE INVENTION

The present invention for a novel heat exchanger and related TLE tube is now described in specific terms sufficient to teach one of skill in the practice the invention herein. In the description that follows, numerous specific details are set forth by way of example for the purposes of explanation and in furtherance of teaching one of skill in the art to practice the invention. It will, however, be understood that the invention is not limited to the specific embodiments disclosed and discussed herein and that the invention can be practiced without such specific details and/or substitutes therefor. The present invention is limited only by the appended claims and may include various other embodiments which are not particularly described herein but which remain within the scope and spirit of the present invention.

One of the key aspects of the present invention is the use of a fin profile having alternating concave and convex surfaces on the process side of the TLE tube. Further, it is preferred that the fins are aligned with the center line (longitudinal axis) of the tube as opposed to twisting or spiraling the fins within the interior of the TLE tube. Through the use of the finned process tube of the present invention, various advantages may be obtained. For example, stagnant and low flow zones are reduced and/or eliminated as are recirculation eddies. As such, fouling problems are mitigated. Further, increased heat transfer function is obtained with the desirable result that tubes can be shortened while still meeting the required heat transfer characteristics for the furnace and process.

In one embodiment of the present invention, a heat exchanger tube is provided. The heat exchanger tube has a longitudinal axis, an interior surface defining the flow area of the tube, and an interior circumference in a plane perpendicular to the longitudinal axis; wherein the interior surface comprises a plurality of axially extending grooves aligned with the longitudinal axis; the grooves formed along the length of the tube and formed as a series of alternating concave and convex surfaces along at least a portion of the interior circumference; and wherein the length of the perimeter of the interior surface in the plane is at least about twenty percent longer than the interior perimeter of a circular tube having substantially the same flow area as the heat exchanger tube.

Figure 1:
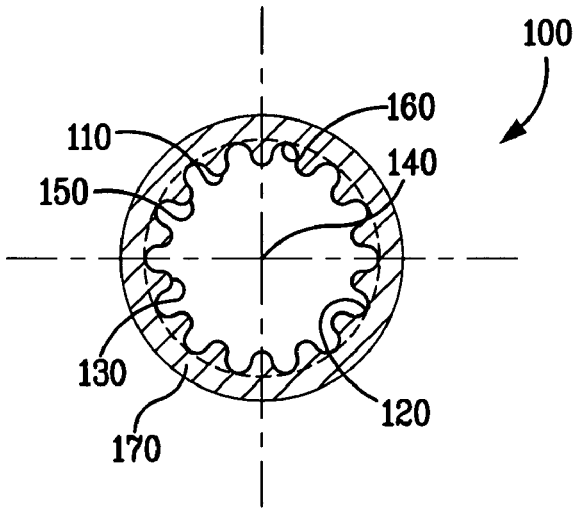
FIG. 1 is a cross-sectional view of a TLE process tube best suited for use with a short-residence time cracking furnace according to the present invention in a preferred embodiment thereof.

FIG. 1 illustrates a cross-sectional view of a TLE process tube suited for use with a short-residence time hydrocarbon cracking furnace according to the present invention in a preferred embodiment thereof is presented. TLE tube 100 incorporates, on its process (internal) surface a finned surface 110 which is present, in this embodiment, around the complete circumference of the process side of the tube 100. Finned surface 110 is comprised of alternating concave 120 and convex 130 surfaces. In one embodiment, the fins, both concave 120 and convex 130, are aligned with tube center line 140 which is an imaginary line running along the longitudinal center (longitudinal axis) of tube 100.

In a preferred embodiment, each of concave 120 and convex 130 surfaces are of similar size and shape to one another such that each of the concave 120 surfaces has a concave nadir 160 and each of said convex 130 surfaces has a convex pinnacle 150, and wherein each of said convex pinnacles 150 are located at substantially the same distance from said longitudinal axis 140 and each of said convex nadirs 160 are located at the same distance from said longitudinal axis 140. In a preferred embodiment, all concave surfaces 120 and convex surfaces 130 have the same radius.

The thickness of the tube wall 170 is determined by the steam pressure in the quench exchanger, which is in turn, determined by the particular application. For example, in one embodiment a typical wall thickness for a tube on the order of about 2 to about 3 inches (about 50 to 76 mm) inside diameter (measured from valley to opposing valley of the fins) may have a wall thickness of about 0.3 to about 0.5 inches (about 7.6 to 12.7 mm). In another embodiment, a typical wall thickness for a tube on the order of about 2 to about 6 inches (about 50 to about 152 mm) inside diameter may have a wall thickness of about 0.2 to about 0.6 inches (about 5.1 to 15.2 mm). FIG. 1 shows a finned surface on the interior of TLE tube 100 having 14 fins within a nominal inner tube diameter of about 2.35 inches (about 60 mm).

As will be readily skilled in the art, the teachings of the present invention may alternatively be applied to tubes of larger or small diameters and the number of fins per unit of diameter may also be increased or decreased as desired for the particular application. That being said, typical dimensions for the inside diameter of the exchanger tube may be in the range of about 2 inches to about 3 inches (about 50 to about 76 mm) for single pass and U-tube type radiant coil units.

For units which are close coupled to serpentine radiant coils, the corresponding exchanger tube inside diameter (measured from valley to opposing valley of the fins) may lie in the range of about 3 inches to 6 about inches (about 76 to about 152 mm) depending upon the diameter of the radiant coil. When used in connection with shell and tube type exchangers, or double pipe units in a bundle arrangement, the corresponding exchanger tube inner diameter may be in the range of about 1.5 inches to about 2.5 inches (about 38 to about 64 mm). Of course, larger and smaller sizes may also be used without departing from the scope or spirit of the present invention.

With specific reference to FIG. 1 and an exemplary embodiment with a nominal inner tube diameter of 2.35 inches (60 mm), an exemplary fin height may be on the order of about 0.1 inches to about 0.3 inches (about 2.5 to 7.6 mm) with about 0.18 inches (4.6 mm) being a preferred embodiment. The number of fins located around the interior circumference of tube 100 will typically vary with the diameter of the tube. However, in a preferred embodiment, the number of fins is in the range of about 5 to about 7 times the inside diameter, measured in inches (0.2 to 0.3 times the inside diameter, measured in mm), of tube 100. For example, in one preferred embodiment, a tube with an interior diameter (from base of fin valley to base of fin valley) of about 2 inches (50 mm) may have on the order of 12 fins. In a preferred embodiment, the length of exchanger tube 100 may be as short as 15 feet (4.5 meters) or as long as 60 feet (18 meters). For use with a hydrocarbon cracking furnace, anything shorter will generally not offer the desired heat transfer characteristics and anything longer may suffer from fabrication and other size-related issues.

The tube illustrated in FIG. 1 may be fed by two single-pass radiant tubes or by a single U-tube from the radiant section. Other embodiments are also possible using the tube design of the present invention.

Figure 2:
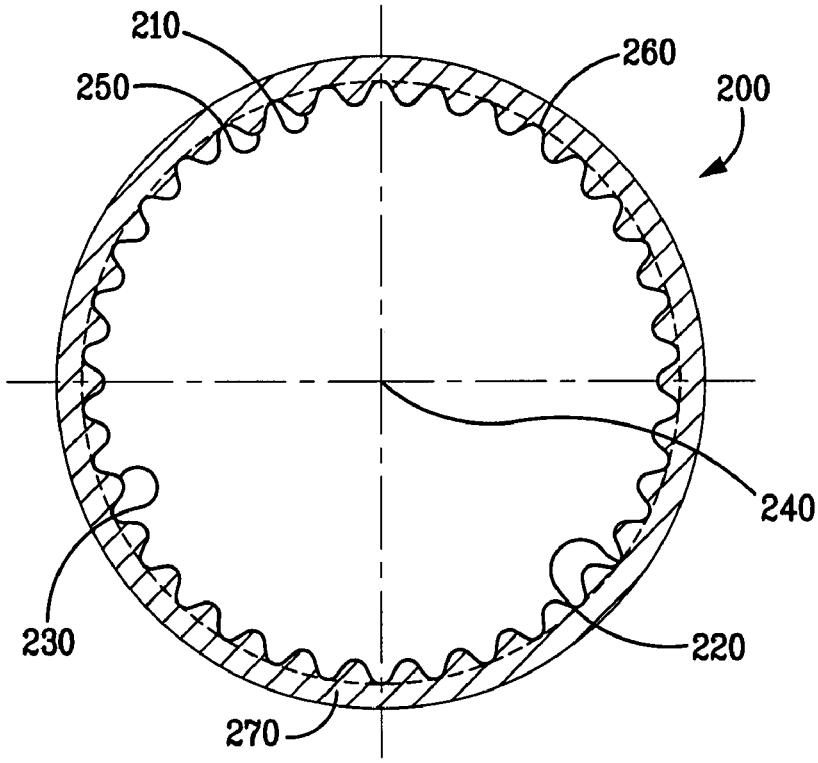
FIG. 2 is a cross-sectional view of a TLE process tube best suited for use in close coupling an exchanger to a serpentine cracking coil furnace according to the present invention in a preferred embodiment thereof.

Turning now to FIG. 2, another possible embodiment of the present invention is now described in connection therewith. FIG. 2 is a cross-sectional view of a TLE process tube best suited for use in close coupling an exchanger to a serpentine cracking coil furnace. In a preferred embodiment, tube 200 shown in FIG. 2 is used to close couple a quench exchanger with a serpentine cracking coil furnace where the radiant outlet tube inside diameter is in the range of about 5.00 to about 5.75 inches (about 127 to about 146 mm). Of course, the tube and finning arrangement illustrated in FIG. 2 can also be applied to a wide variety of other applications.

As can be seen from FIG. 2, similar elements to the embodiment shown in FIG. 1 are present in this embodiment. However, in this case, a typical inside diameter from valley to valley is on the order of 5.75 inches (146 mm). Tube 200 preferably includes finned surface 210 having an alternating concave 220 and convex 230 surface. Again, the surface is preferably centered on center longitudinal axis 240. Convex pinnacles 250 and concave nadirs 260 are also present. It is also preferred that all concave surfaces 220 and convex surfaces 230 have the same radius. The thickness of tube wall 270 is determined by the steam pressure in the quench exchanger, which is in turn, determined by the particular application. For example, a typical wall thickness for a tube on the order of about 5 to about 5.75 inches (127 to about 146 mm) in diameter may have a wall thickness of about 0.5 to about 0.75 inches (about 12.7 mm to about 19 mm).

Figure 3A:
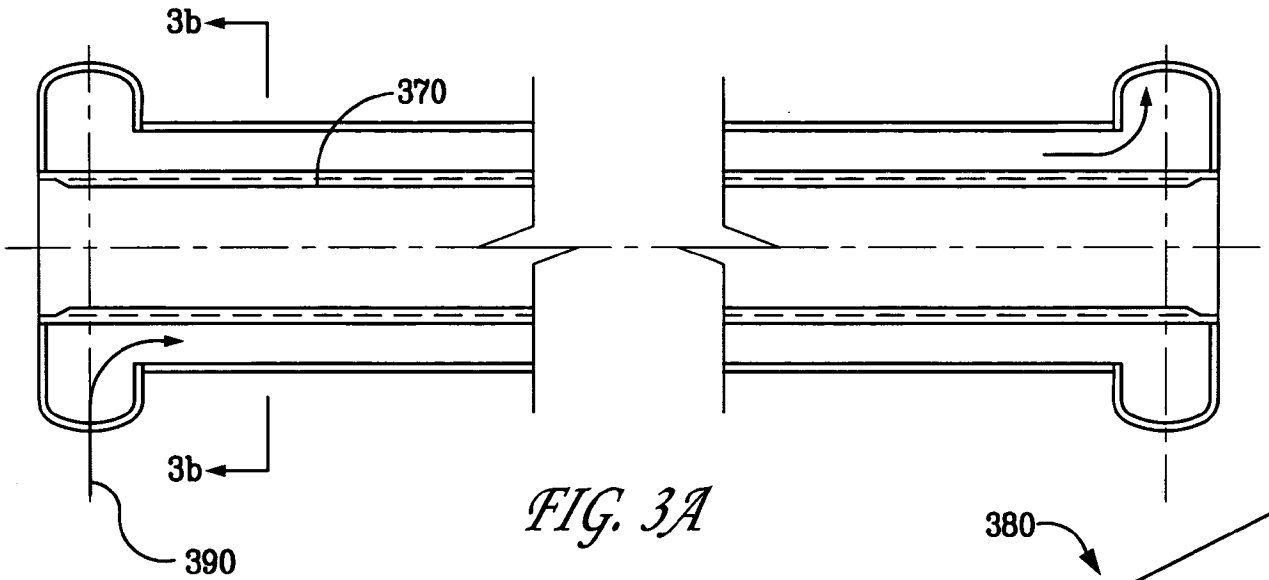
FIG. 3A is a cross-sectional view of a double pipe quench exchanger incorporating a TLE process tube of the present invention in one embodiment thereof.
Figure 3B:
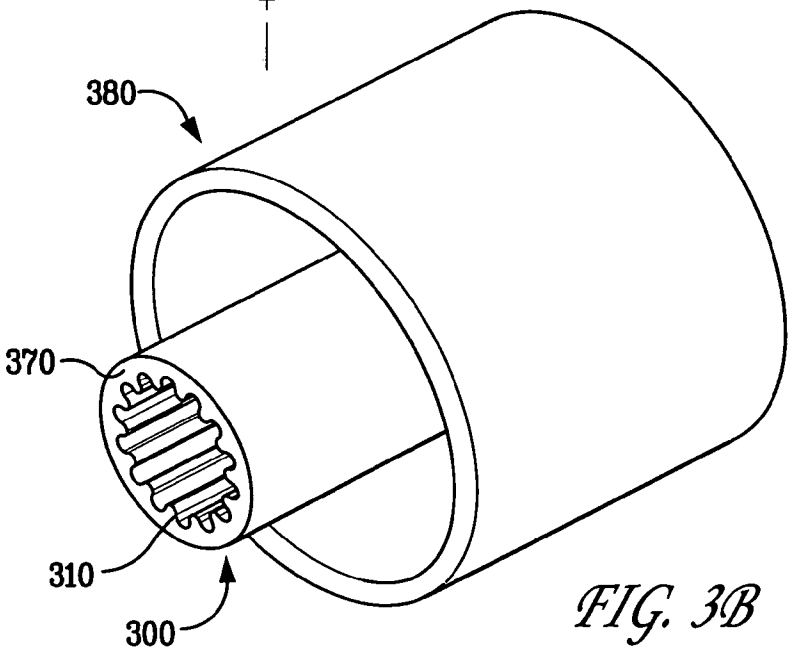
FIG. 3B is a sectional view taken along the line 3*b*-3*b* of the quench exchanger illustrated in FIG. 3A.

Turning now to FIGS. 3A and 3B, a cross-sectional view of a double pipe quench exchanger incorporating a TLE process tube and a sectional view taken along the line 3*b*-3*b* of the quench exchanger illustrated in FIG. 3A are presented. In this case, the finned TLE process tube 300 of the present invention is incorporated into double pipe quench exchanger 380 of the present invention. Process tube 300 includes wall 370 and finned interior surface 310 as described above with reference to FIGS. 1 and 2. In FIG. 3A, BFW inlet flow 390 can be seen. BFW with steam flows along the outside wall of tube 300 as is known in the art.

Figure 4A:
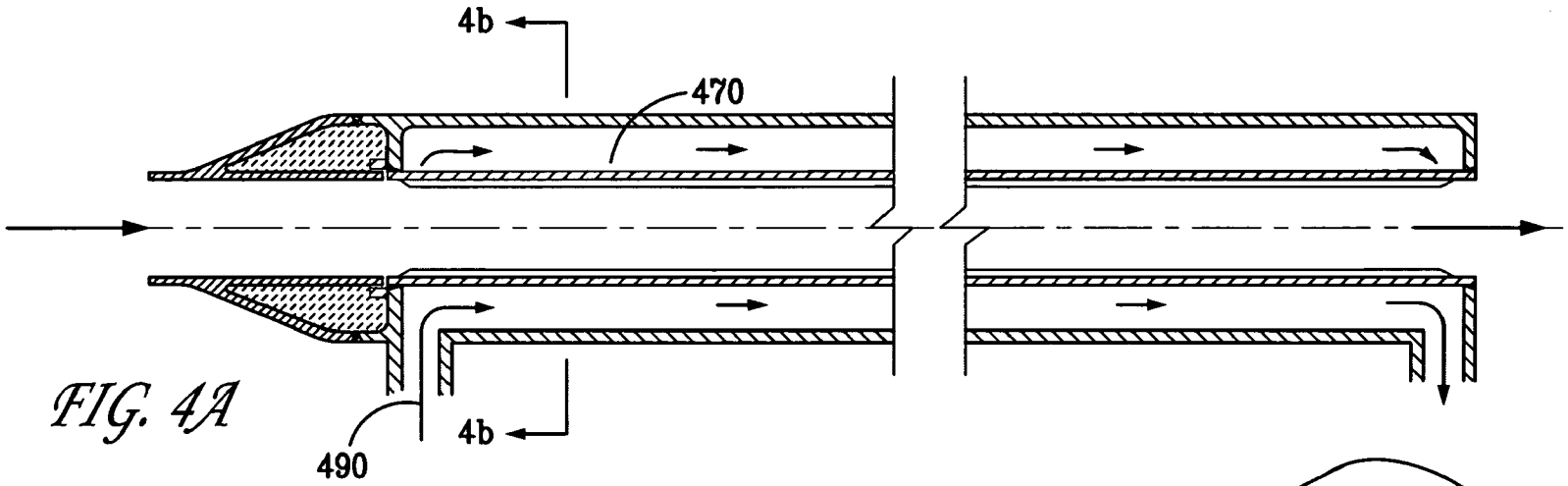
FIG. 4A is a cross-sectional view of a double pipe quench exchanger incorporating a TLE process tube of the present invention in another embodiment thereof.
Figure 4B:
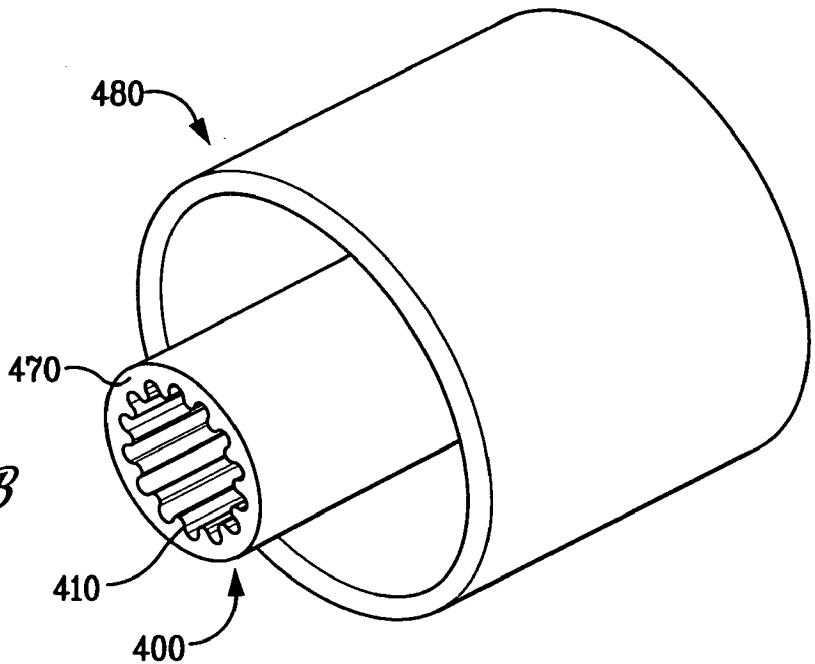
FIG. 4B is a sectional view taken along the line 4*b*-4*b* of the quench exchanger illustrated in FIG. 4A.

In the embodiment illustrated by FIGS. 3A and 3B a TLE tube with a so-called "oval-header" design is employed. An alternative embodiment is also possible and is shown in FIGS. 4A and 4B. In this embodiment, a TLE tube without such an oval-header design is used. As shown in FIG. 4A, a cross-sectional view of a double pipe quench exchanger incorporating a TLE process tube is shown. In FIG. 4B, a sectional view taken along the line 4*b*-4*b* of the quench exchanger illustrated in FIG. 4A is presented. In this case, the finned TLE process tube 400 of the present invention is incorporated into double pipe quench exchanger 480 of the present invention. Process tube 400 includes wall 470 and finned interior surface 410 as described above. In FIG. 4A, BFW inlet flow 490 is also depicted. BFW, with steam, flows along the outside wall of tube 400 as is known in the art. As may be appreciated by those skilled in the art, this design may also be readily implemented in commercial double-pipe TLE applications as described above.

An example of an application of the teachings of the present invention along with the achieved benefits thereof is now discussed. In this case, an older steam cracking furnace employs a four-pass serpentine radiant coil with each of the four radiant outlet tubes having an inside diameter of about 5.25 inches (133 mm). Prior to employing the teachings of the present invention, the four outlet passes are manifolded together and fed to a circular quench exchanger of the type shown in FIGS. 4 and 5 of the Herrmann paper, discussed above. In this state, the furnace experiences an undesirably long "unfired residence time" due to the time required for manifolding and the time required for the effluent to traverse the inlet chamber of the quench exchanger.

It is desirable to use a close-coupled double-pipe quench exchanger to quench the effluent from each of the four radiant passes. The geometrical constraints imposed by the existing furnace limit the length of the double-pipe quench exchanger to a maximum of thirty feet. Using a conventional, circular quench exchanger tube profile, the predicted outlet temperature from the double pipe exchanger is about 1190° F. (645° C.), which provides insufficient operating margin from the practical upper limit of about 1200 to about 1250° F. (about 650° C. to about 675° C.).

By using an internally finned quench exchanger tube such as the one described in connection with FIG. 2 herein, a quench exchanger outlet temperature of about 1114° F. (600° C.) is predicted according to a software simulation using heat transfer correlations well known to those skilled in the art. This temperature is sufficiently low to allow the effluent from the four double pipe close-coupled quench exchangers to be manifolded together before passing to the existing circular TLE for further heat recovery.

The tubes and the extended surface feature of the present invention as described above may be incorporated into a variety of quench exchanger types and designs. For example and without limitation, the teachings herein may be applied to double pipe exchangers and shell and tube type exchangers. In the case of double pipe units, the design may be linear arrangements or arrangements with multiple units positioned in a bundle with a common inlet changer and a common outlet chamber. If arranged as a linear unit, the unit may be close coupled to the radiant coil to minimize adiabatic time between leaving the furnace fired zone and entering the quench exchanger.

When used as a linear, close coupled unit, it is preferable that one or more radiant tubes be included with one or more radiant tubes feeding each quench exchanger tube. It is preferable in this case that if the radiant coil is a single pass coil, 2 or 4 radiant tubes feed each quench exchanger tube. Alternatively, if the radiant coil is a two-pass or U-tube coil, it is preferable that one or two radiant coil feeds each quench exchanger tube. Further, if the radiant coil is a serpentine coil, it is preferred that one radiant coil feeds each quench exchanger tube.

In the event that the TLE tube of the present invention is incorporated into a shell and tube type exchanger or a double pipe exchanger with multiple double pipe units mounted together in a bundle with a common inlet chamber, multiple radiant coils can be fed to multiple quench exchanger tubes regardless of the radiant coil type.

The teachings of the present invention have particular application to processes with light feeds such as gas and naphtha cracking applications. Additionally, the TLE tubes and the heat exchanger incorporating said tubes may have application in other processes such as gas-oil and other heavy feed based processes. This includes, by way of example and not limitation, gas-oil cracking applications, other heavy feed applications including atmospheric and vacuum gas-oils as well as virgin and hydro-treated gas-oils (to include both mildly hydro-treated gas-oils and severely hydro-cracked gas-oils). Other feeds may include, for example, crude oil and crude oil fractions from which non-volatile components have been removed. Further, the invention may also have application to feeds comprising field condensates with high final boiling points (e.g. above about 600° F. (315° C.).

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A heat exchanger comprising a heat exchanger tube having a longitudinal axis, an interior surface defining the flow area of said tube, an inside diameter and an interior circumference in a plane perpendicular to said longitudinal axis; wherein said interior surface comprises a plurality of axially extending grooves aligned with said longitudinal axis; said grooves formed along the length of said tube and formed as a series of alternating concave and convex surfaces along at least a portion of said interior circumference; and wherein the length of the perimeter of said interior surface in said plane is at least about twenty percent longer than the interior perimeter of a circular tube having substantially the same flow area as said heat exchanger tube, wherein the said heat exchanger is a concentric tube heat exchanger.

2. The heat exchanger of claim 1 wherein said concave and convex surfaces form a plurality of convex fins, and wherein the number of convex fins is equal to about 5 to about 7 times the inside diameter of said heat exchanger tube when measured in inches.

3. The heat exchanger of claim 1 wherein each of said concave surfaces has a concave nadir and each of said convex surfaces has a convex pinnacle; and wherein each of said convex pinnacles are located at substantially the same distance from said longitudinal axis and each of said convex nadirs are located at the same distance from said longitudinal axis.

4. The heat exchanger of claim 3 wherein the inside diameter of said heat exchanger tube is about 2 to about 6 inches (about 50 to about 152 mm) and the wall thickness of said tube is about 0.2 to about 0.6 inches (about 5.1 to 15.2 mm).

5. The heat exchanger of claim 4 wherein each of said convex pinnacles are located from about 0.75 inches (19.0 mm) to about 2.75 inches (69.8 mm) from said longitudinal axis; and each of said concave nadirs are located from about 1.0 inches (25.4 mm) to about 3.0 inches (76.2 mm) from said longitudinal axis.

6. The heat exchanger of claim 3 wherein the inside diameter of said heat exchanger tube is about 2 to about 3 inches (about 50 to about 76 mm) and the wall thickness of said heat exchanger tube is about 0.3 to about 0.5 inches (about 7.6 to 12.7 mm).

7. The heat exchanger of claim 6 wherein each of said convex pinnacles are located from about 0.75 inches (19.0 mm) to about 2.75 inches (69.8 mm) from said longitudinal axis; and each of said concave nadirs are located from about 1.0 inches (25.4 mm) to about 3.0 inches (76.2 mm) from said longitudinal axis.

8. The heat exchanger of claim 1 wherein the length of said heat exchanger tube is from about 15 feet to about 60 feet (about 4.5 meters to about 18 meters).

9. The heat exchanger of claim 1 wherein the height of each groove is from about 0.1 inches (2.54 mm) to about 0.3 inches (7.62 mm).

10. The heat exchanger of claim 1 wherein the inside diameter of said heat exchanger tube is about 2 to about 6 inches (about 50 to about 152 mm); the wall thickness of said tube is about 0.2 to about 0.6 inches (about 5.1 to 15.2 mm); the height of each groove is from about 0.1 inches (2.54 mm) to about 0.3 inches (7.62 mm); and the length of said heat exchanger tube is from about 15 feet to about 60 feet (about 4.5 meters to about 18 meters).

11. A transfer line heat exchanger unit arranged as a linear unit, said transfer line heat exchanger unit connected to a steam cracking furnace, in which heated furnace effluent flows from a furnace outlet into at least one heat exchanger tube for cooling said furnace effluent; wherein said at least one heat exchanger tube has a longitudinal axis, an interior surface defining the furnace effluent flow area of said tube, an inside diameter and an interior circumference in a plane perpendicular to said longitudinal axis; and wherein said interior surface comprises a plurality of axially extending grooves aligned with said longitudinal axis; said grooves formed along the length of said tube and formed as a series of alternating concave and convex surfaces along at least a portion of said interior circumference; and wherein the length of the perimeter of said interior surface in said plane is at least about twenty percent longer than the interior perimeter of a circular tube having substantially the same flow area as said heat exchanger tube, wherein the said transfer line heat exchanger is a concentric tube transfer line heat exchanger.

12. The transfer line heat exchanger unit of claim 11, wherein said heat exchanger tube is used to cool effluent from a hydrocarbon cracking furnace and is fed by at least one radiant tube associated with said furnace.

13. The transfer line heat exchanger unit of claim 11 wherein said concave and convex surfaces form a plurality of convex fins, and wherein the number of convex fins is equal to about 5 to about 7 times the inside diameter of said heat exchanger tube when measured in inches.

14. The transfer line heat exchanger unit of claim 11 wherein each of said concave surfaces has a concave nadir and each of said convex surfaces has a convex pinnacle; and wherein each of said convex pinnacles are located at substantially the same distance from said longitudinal axis and each of said convex nadirs are located at the same distance from said longitudinal axis.

15. The transfer line heat exchanger unit of claim 14 wherein the inside diameter of said heat exchanger tube is about 2 to about 6 inches (about 50 to about 152 mm) and the wall thickness of said tube is about 0.2 to about 0.6 inches (about 5.1 to 15.2 mm).

16. The transfer line heat exchanger unit of claim 15 wherein each of said convex pinnacles are located from about 0.75 inches (19.0 mm) to about 2.75 inches (69.8 mm) from said longitudinal axis; and each of said concave nadirs are located from about 1.0 inches (25.4 mm) to about 3.0 inches (76.2 mm) from said longitudinal axis.

17. The transfer line heat exchanger unit of claim 11 wherein the inside diameter of said heat exchanger tube is about 2 to about 3 inches (about 50 to about 76 mm) and the wall thickness of said heat exchanger tube is about 0.3 to about 0.5 inches (about 7.6 to 12.7 mm).

18. The transfer line heat exchanger unit of claim 17 wherein each of said convex pinnacles are located from about 0.75 inches (19.0 mm) to about 1.4 inches (35.6 mm) from said longitudinal axis; and each of said concave nadirs are located from about 1.0 inches (25.4 mm) to about 1.5 inches (38.1 mm) from said longitudinal axis.

19. The transfer line heat exchanger unit of claim 11 wherein the length of said heat exchanger tube is from about 15 feet to about 60 feet (about 4.5 meters to about 18 meters).

20. The transfer line heat exchanger unit of claim 11 wherein the height of each groove is from about 0.1 inches (2.54 mm) to about 0.3 inches (7.62 mm).

21. The transfer line heat exchanger unit of claim 11 wherein: the inside diameter of said heat exchanger tube is about 2 to about 6 inches (about 50 to about 152 mm); the wall thickness of said tube is about 0.2 to about 0.6 inches (about 5.1 to 15.2 mm); the height of each groove is from about 0.1 inches (2.54 mm) to about 0.3 inches (7.62 mm); and the length of said heat exchanger tube is from about 15 feet to about 60 feet (about 4.5 meters to about 18 meters).

* * * * *